US006179610B1

(12) United States Patent
Suey et al.

(10) Patent No.: US 6,179,610 B1
(45) Date of Patent: Jan. 30, 2001

(54) COMPOSITE REFRACTORY TILE FOR METALLURGICAL FURNACE MEMBERS

(76) Inventors: Paul V. Suey, deceased, late of McKeesport, PA (US); by Carole Suey Nguyen, legal representative, P.O. Box 121, McKeesport, PA (US) 15135

( * ) Notice: Under 35 U.S.C. 154(b), the term of this patent shall be extended for 0 days.

(21) Appl. No.: 09/475,516

(22) Filed: Dec. 30, 1999

(51) Int. Cl.[7] ..... F27D 3/02
(52) U.S. Cl. ..... 432/233; 432/234; 138/149
(58) Field of Search ..... 432/233, 234; 138/149, 137

(56) References Cited

U.S. PATENT DOCUMENTS

| | | | | |
|---|---|---|---|---|
| 3,881,864 | | 5/1975 | Nicol | 432/234 |
| 3,891,006 | * | 6/1975 | Lee | 138/106 |
| 4,015,636 | | 4/1977 | Van Fossen | 138/149 |
| 4,070,151 | | 1/1978 | Suey | 432/234 |
| 4,071,311 | | 1/1978 | Errington | 432/234 |
| 4,140,484 | | 2/1979 | Payne | 432/234 |
| 4,225,307 | | 9/1980 | Magern | 432/234 |
| 4,330,266 | | 5/1982 | Suey | 432/234 |
| 4,393,569 | | 7/1983 | Byrd, Jr. | 29/460 |
| 4,424,027 | | 1/1984 | Suey | 432/233 |
| 4,427,187 | | 1/1984 | Denis | 266/274 |
| 4,450,872 | | 5/1984 | Orcutt | 138/149 |
| 4,539,055 | | 9/1985 | Orcutt | 156/92 |
| 4,906,525 | | 3/1990 | Seguchi et al. | 428/469 |
| 5,154,605 | | 10/1992 | Suey | 432/234 |
| 6,000,438 | * | 12/1999 | Ohrn | 138/149 |

* cited by examiner

*Primary Examiner*—Denise L. Ferensic
*Assistant Examiner*—Jiping Lu
(74) *Attorney, Agent, or Firm*—Armstrong, Westerman, Hattori, McLeland & Naughton

(57) ABSTRACT

In a metallurgical furnace of the type for re-heating metal billets and slabs, a pair of composite refractory tiles for insulating fluid-cooled structural members of the furnace. The tiles are a composite of a cast refractory shell which extends radially inward at selected portions to contact the furnace member. Attachment assemblies are embedded in the cast refractory shell and maintain proper alignment of each tile with the furnace structural member. In portions of the tile where contact with the furnace member is not made, a ceramic fiber insulating blanket fills a hollow between the refractory shell and the furnace member. Incorporating the ceramic fiber insulating blanket into each tile decreases furnace heat loss as compared to solid cast refractory tiles of comparable thickness.

13 Claims, 9 Drawing Sheets

COMPOSITE REFRACTORY TILE FOR METALLURGICAL FURNACE MEMBERS

BACKGROUND OF THE INVENTION

1. Field of the Invention

This invention relates to metallurgical furnaces of the type used to reheat metal prior to hot working, wherein certain water-cooled furnace members are covered with refractory material so as to insulate and protect them from the hot furnace gases.

2. Description of Related Art

Furnaces for heating metal during processing often operate at temperatures up to about 2400° F. At such elevated temperatures it is necessary to protect furnace structural members from such intense heat. Furnace members providing support for heavy metal sections, such as billets or slabs being heated in such furnaces, are insulated and cooled internally with circulating fluid so as to maintain the strength required to support such loads.

Furnace support members for heavy metal sections, commonly referred to as skid rails, typically consist of horizontally oriented water cooled pipes having an upwardly projecting wear surface along their length. The heavy metal sections to be heated are slid along the wear surfaces of such support members as they move from the furnace entrance to the furnace exit. Insulation for the support members is commonly of a single refractory material or can be made up of layered composite materials. A multitude of different means are employed to secure the insulation to the furnace members in a manner to withstand the high temperature, thermal shock, vibration, and other forces to which the furnace members and insulation are subjected. Relative ease of installation is of importance due to the requirement for periodic replacements.

U.S. Pat. No. 3,881,864 describes a refractory tile surrounding an inner fibrous refractory material about a furnace skid rail wherein two complimentary c-shaped blocks interengage beneath the skid rail to secure the insulation in place. No additional means is provided for securement.

U.S. Pat. No. 4,393,569 describes a module wherein the support member is wrapped with refractory fiber insulating material which is protected by an outer refractory ceramic fiber blanket folded into at least two layers.

U.S. Pat. No. 4,140,484 describes a tubular supporting member sheathed by refractory sheathing comprising an inner layer of fibrous refractory material and an outer layer of refractory tiles held in place by metal links which are secured together around the supporting members.

U.S. Pat. No. 4,071,311 describes a metal tubular supporting member sheathed by an inner layer of refractory fibrous material and an outer layer consisting of pairs of semi-cylindrical refractory tiles. The refractory tiles are held in place by metal coupling links covered and positively engaged by adjacent tiles.

U.S. Pat. No. 4,015,636 describes a three-layer insulating assembly comprising an inner fibrous thermal insulation, an intermediate split ceramic refractory, and an outer protective ceramic covering.

U.S. Pat. No. 4,450,872 describes a covering comprising an inner layer of thermal insulating ceramic refractory fiber blanket, an open weave ceramic cloth about the blanket, an inner layer of veneering mortar, compressed rings of ceramic fiber material, and a hot face layer of veneering coating.

U.S. Pat. No. 3,881,864 describes a refractory tile for sheathing a furnace member, preferably around an inner layer of fibrous refractory material. "C" shaped complimentary tiles interengage each other underneath the member to hold them in position.

All of the listed prior art insulating tiles incorporate at least two layers of insulating material with each layer having generally concentric inner and outer cylindrically shaped surfaces.

SUMMARY OF THE INVENTION

The present invention provides a composite refractory tile for insulating fluid conveying structural members of a metallurgical furnace wherein a hollow is incorporated into certain portions of a cast refractory shell of the tile and a ceramic fiber insulating blanket fills such hollow. Metal attachment devices are embedded in the cast refractory component of the tile for use in rigidly attaching the tile to the fluid conveying member. The cast refractory shell of the tile extends radially inward and contacts the furnace member in the immediate area of each attachment device. Also, at each end of the tile the cast refractory shell extends radially inward and contacts the furnace member. In the remaining portions of the tile the cast refractory shell is spaced from the furnace member and a ceramic fiber insulating blanket fills the thus formed hollow of the cast refractory.

Other specific features and contributions of the invention are described in more detail below with reference being made to the accompanying drawings.

DETAILED DESCRIPTION OF THE INVENTION

Figure 1:
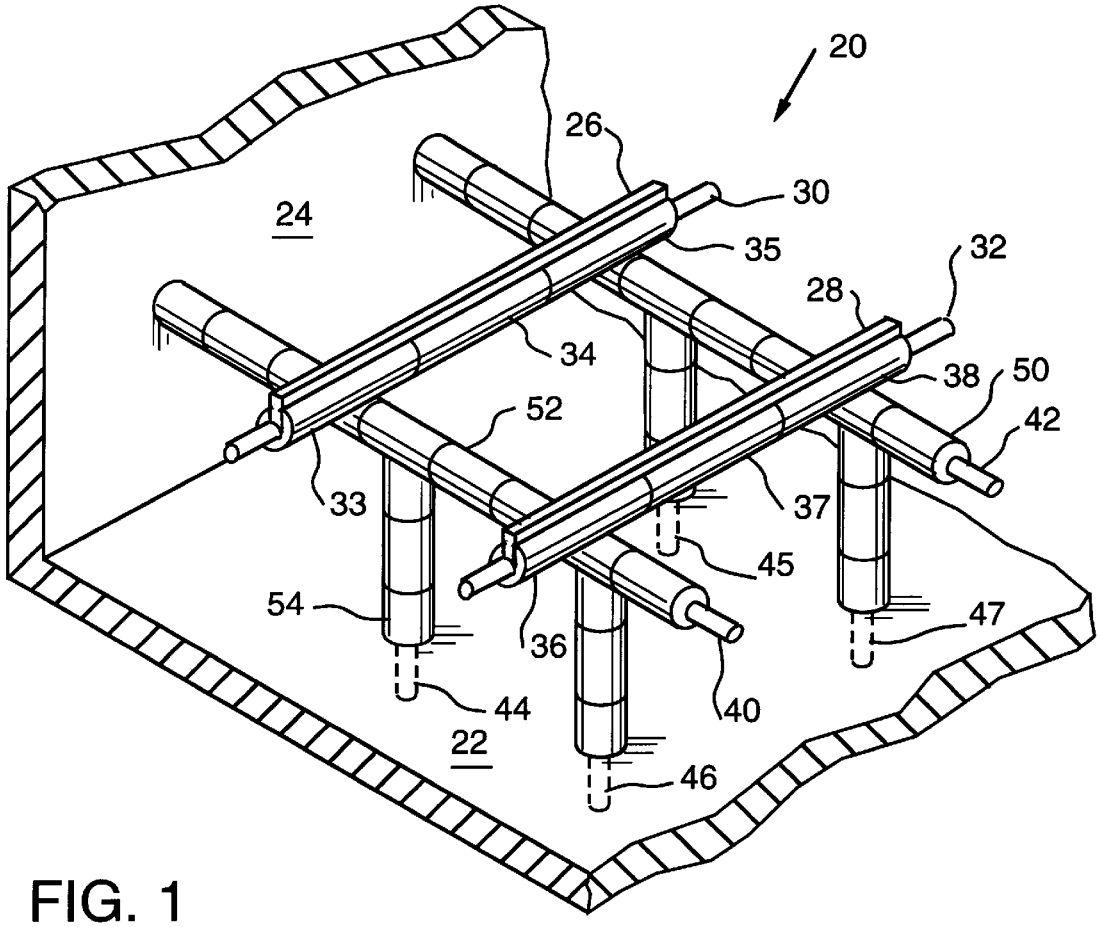
FIG. 1 is a perspective view of the general layout of water cooled supporting members in a metallurgical re-heat furnace.

FIG. 1 depicts a partial section of a metallurgical furnace 20 for use in re-heating heavy metal sections such as slabs or billets prior to a hot working operation. Temperatures up to about 2400° F are encountered in the furnace requiring cooling of structural members subjected to such hot furnace gases. The invention is described for the most part for use with structural members of such a furnace comprising cylindrically shaped internally water cooled pipes, however embodiments for use with furnace members having other cross sections are also described.

In furnace 20 refractory floor 22 and wall 24 make up a portion of a furnace enclosure for containing hot furnace gases. Heavy metal sections to be heated are slid along solid metal skid rails 26 and 28 which project from horizontally oriented water cooled pipes 30 and 32 which are insulated from the furnace gases by pairs of composite refractory insulating tiles of the invention. Tiles 33, 34 and 35 cover pipe 30 and tiles 36, 37 and 38 cover pipe 32. Such pipes, incorporating a skid rail, are supported by horizontally oriented water cooled pipes 40 and 42, which are absent any skid rails, and in turn pipes 40 and 42 are supported by vertically oriented water cooled pipes 44, 45, 46 and 47. Composite refractory insulating tiles also cover the supporting pipes absent the skid rails, for example tile 50 on pipe 42 and tile 52 on pipe 40. Vertically oriented pipes 44, 45, 46 and 47 are also covered with tiles, for example tile 54 on pipe 44. All of the aforementioned pipes are cooled by internally flowing water or other fluid so as to maintain the temperature of the pipes at a level at which they are structurally capable of supporting the heavy metal sections being heated and slid along skid rails 26 and 28. The insulating tiles significantly reduce heat loss from the furnace to the circulating coolant. The insulating tiles of the invention fulfill the need for limiting heat flow from the furnace to the fluid while also providing a protective outer shell to resist the harsh environment consisting of the furnace gases and/or slag, scale and debris from the surfaces of the heavy metal sections being heated.

Figure 2:
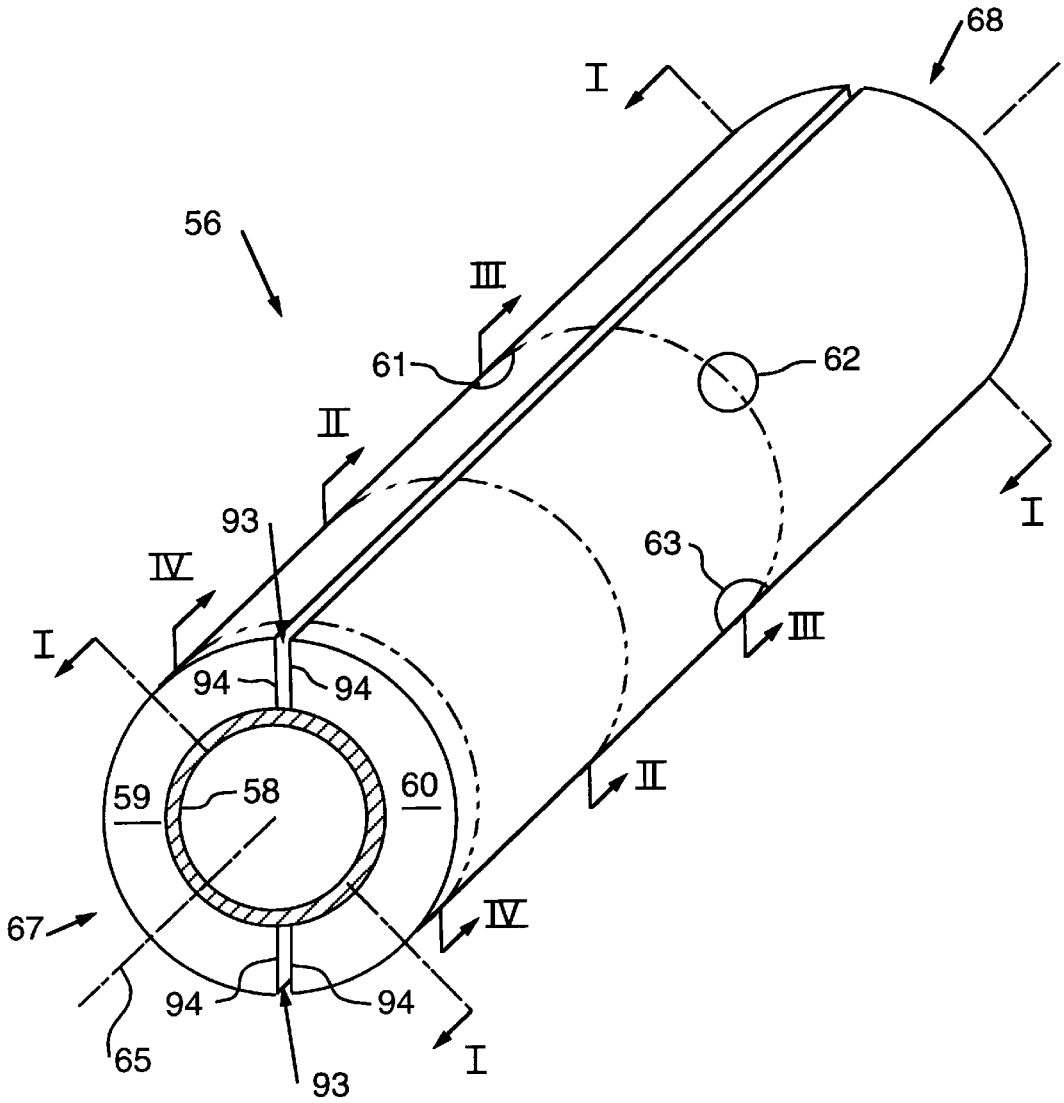
FIG. 2 is a perspective view of a pair of the composite refractory insulating tiles of the invention.

FIG. 2 is a perspective view of a pair of elongated insulating tiles of the invention. Such pairs of tiles are assembled end to end along the furnace members as depicted in FIG. 1. Gaskets, not shown, can be provided between longitudinal ends of adjacent pairs of tiles to provide a seal and to allow for thermal expansion and contraction.

In FIG. 2 a pair of insulating tiles 56 is disposed about cooling fluid conveying pipe 58. In the embodiment shown, the pair of tiles 56 is made up of two mating "IC" shaped tiles 59 and 60 so as to facilitate installation. Cavities 61, 62, and 63 provide access for welding attachment assemblies (described below), which are embedded in the tiles, to the metal pipe during installation. Such cavities can be filled with a refractory cement following completion of installation. In a preferred embodiment, access to the attachment means is such as to enable use of a mig-welder as described in U.S. Pat. No. 4,424,027, having the same assignee as the present application, and which is incorporated herein by reference. Placement and number of the attachment assemblies can vary and are dependent on specifics of the installation. In FIG. 2, for clarity, solely an outer surface of the pair of tiles is shown. Cross sections of the tiles, taken in a plane containing longitudinal axis 65 and indicated at I—I, and planes perpendicular to longitudinal axis 65 and indicated at II—II, III—III, and IV—IV show internal details of the tiles in FIGS. 3, 4, 5 and 6 respectively.

Figure 3:
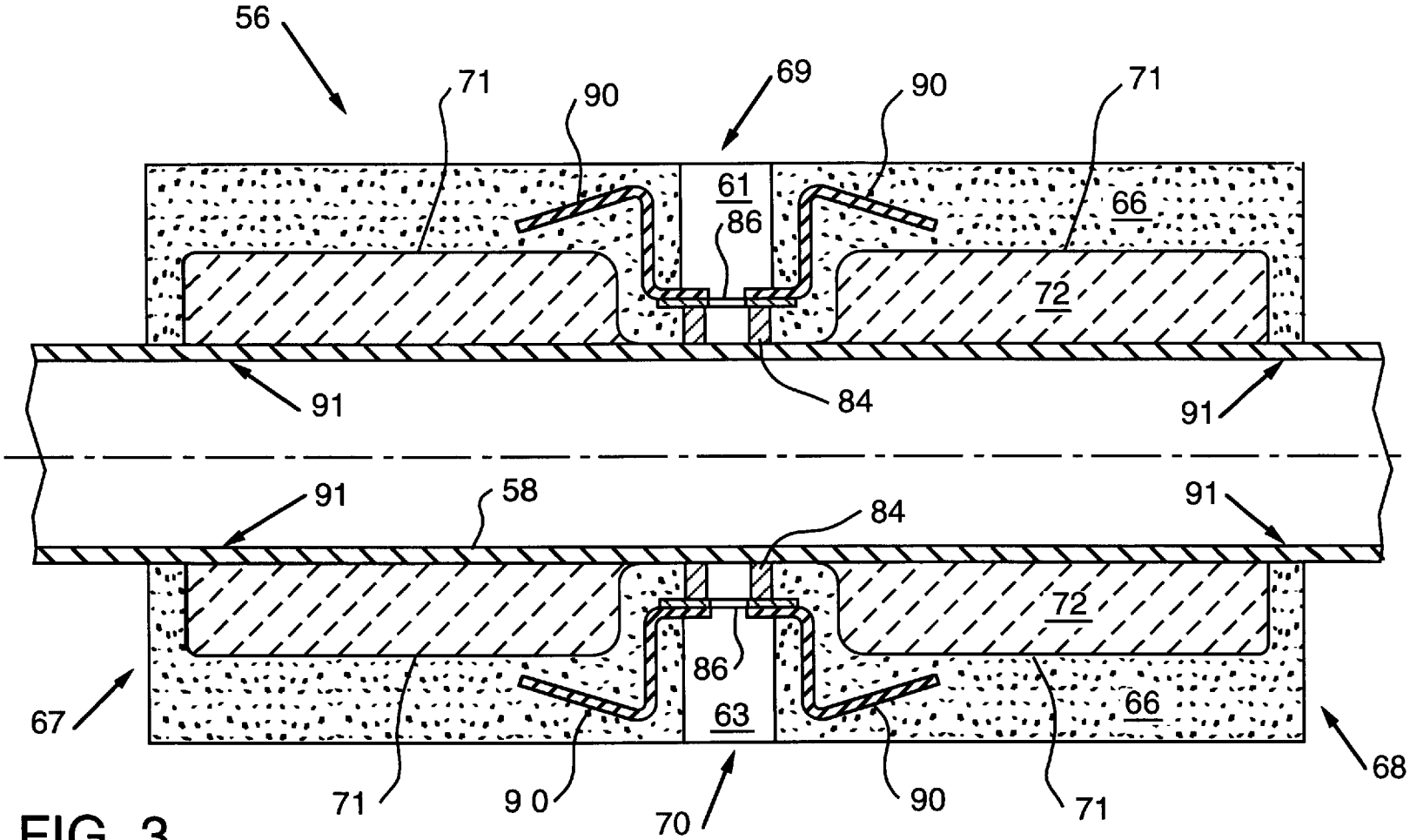
FIG. 3 is a longitudinal sectional view of a pair of the composite refractory insulating tiles of the invention in a plane indicated at I—I of FIG. 2.

FIG. 3 is a longitudinal sectional view in a plane containing longitudinal axis 65 and indicated as I—I in FIG. 2. The plane passes through attachment assemblies associated with cavities 61 and 63 and substantially longitudinally divides the pair of tiles in half.

Each tile consists of a cast refractory shell 66 adapted for disposing about fluid-conveying pipe 58. In a preferred embodiment of the invention, when disposed, such refractory shell contacts pipe 58 solely near each longitudinal end wall 67 and 68, and in the immediate area of each attachment assembly 69 and 70. An inner face 71 of the cast refractory shell defines a hollow which is filled by a ceramic fiber insulating blanket 72. Such blanket contacts pipe 58 at portions not contacted by cast refractory 66.

In a preferred embodiment such fiber blanket is an alumina-silica ceramic fiber blanket sold as CERABLANKET by Thermal Ceramics Co. Outer shell 66 is a cast refractory material such as alumina-silica sold as "MIX 200" by Sil-Base Co. Inc. Ceramic fiber blanket 72 has a higher insulating k value than the cast refractory material and the composite tile is a better insulator than a tile of similar total thickness fabricated solely of the cast refractory material. Use of solely the fiber blanket, with its superior insulating properties, is prohibited due to the adverse effects on the blanket by the harsh environmental conditions in the furnace, referred to above. Outer cast refractory shell 66 protects inner ceramic fiber blanket 72.

Figure 4:
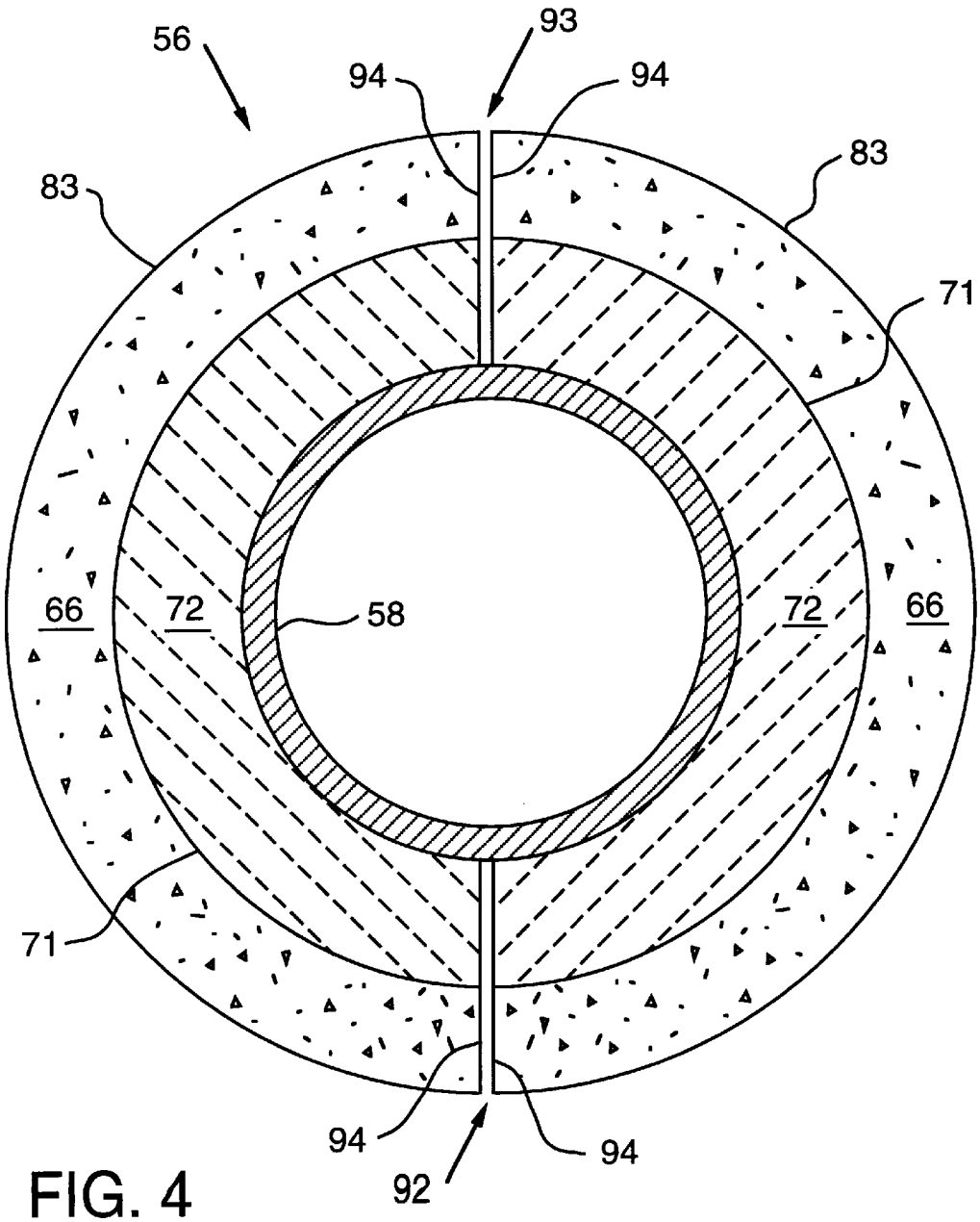
FIG. 4 is a cross sectional view of a pair of the composite refractory insulating tiles of the invention in a plane indicated at II—II of FIG. 2.

FIG. 4 is a cross sectional view in a plane perpendicular to longitudinal axis 65 and indicated as II—II in FIG. 2. The features of the pair of tiles depicted in FIG. 4 are indicative of the tiles at portions spaced from longitudinal end walls 67 and 68 (FIG. 2), and portions spaced from the means for attaching the tiles to pipe 58 (described in more detail below) . Such composite or layered type insulating covering is known and is the subject of related art briefly described above. Referring to FIG. 4, the tiles consist of insulating ceramic fiber blanket 72 disposed to encompass and contact pipe 58 and cast refractory shell 66 encompassing the insulating fiber blanket. The composite tiles of the invention are similar to those known in the art and exemplified above only at such spaced portions; the composite tiles of the invention differ at portions of the tiles in the immediate area of the attachment assemblies and in portions near each longitudinal end.

Figure 5:
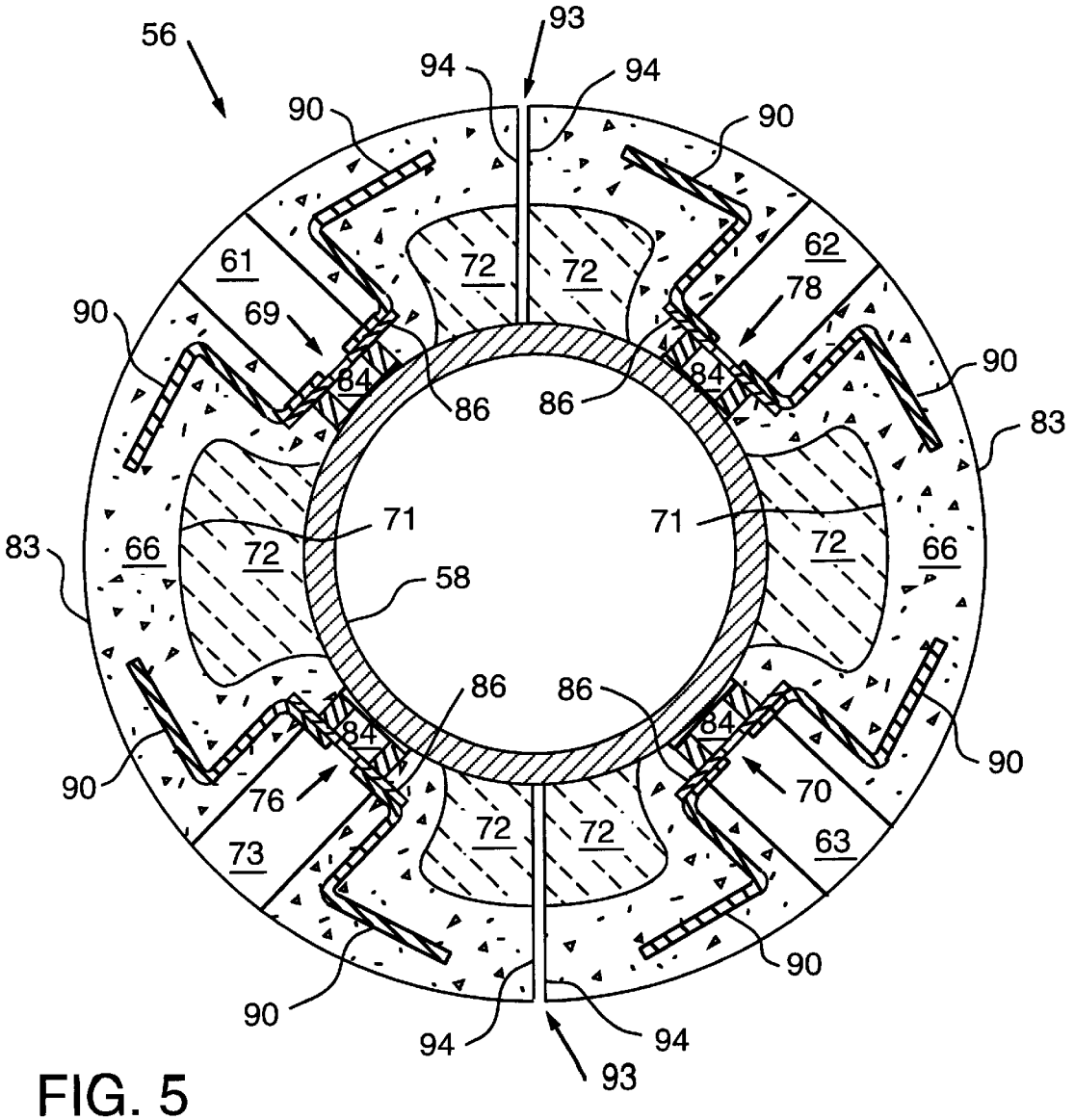
FIG. 5 is a cross sectional view of a pair of the composite refractory insulating tiles of the invention in a plane through attachment means indicated at III—III of FIG. 2.

FIG. 5 depicts the configuration of the tile in the immediate area of each attachment assembly. Cross section III—III (FIG. 2) is perpendicular to longitudinal axis 65 and passes through the attachment assemblies associated with cavities 61, 62, 63 and 73. Referring to FIG. 5, attachment assemblies 69, 70, 76 and 78 are embedded in cast refractory shell 66 and are positioned so as to contact pipe 58 when the tiles are applied to such pipe. In the immediate areas of each such attachment assembly cast refractory shell 66 extends radially inward as a protrusion to contact pipe 58. In portions of the tiles removed from the immediate areas of the attachment assemblies the cast refractory provides only an outer protective shell and the hollow between cast refractory shell 66 and pipe 58 is filled with refractory fiber blanket 72 as depicted in FIG. 4 and as seen between attachment assembly areas of FIGS. 3 and 5. Such configuration, wherein the attachment assemblies contact the pipe and are embedded in the cast refractory, provides a solid radial aligning mechanism for aligning the composite tiles with the pipes. Such aligning feature is contrasted with prior practice composite insulating tiles which provided no positive aligning mechanism.

The attachment assembly in the preferred embodiment consist of welding base 84, (FIG. 5) flat washer 86 and a plurality of anchoring wires 90. Welding base 84 and washer 86 are of carbon steel and the anchoring wires are of about 3/16 inch stainless steel wire. The components of each attachment assembly are welded together prior to being cast into the refractory of the composite tile. Cavities 61, 62, 63 and 73 in cast refractory shell 66 provide access for welding each base 84 to pipe 58, preferably with a mig-welder, during application of the tile to pipe 58. Following the welding operation cavities 61, 62, 63 and 73 are filled with a refractory insulating material. Variations in the attachment means are possible in practice of the invention. Positioning and number of attachment assemblies are dependent on length of the composite tile.

Figure 6:
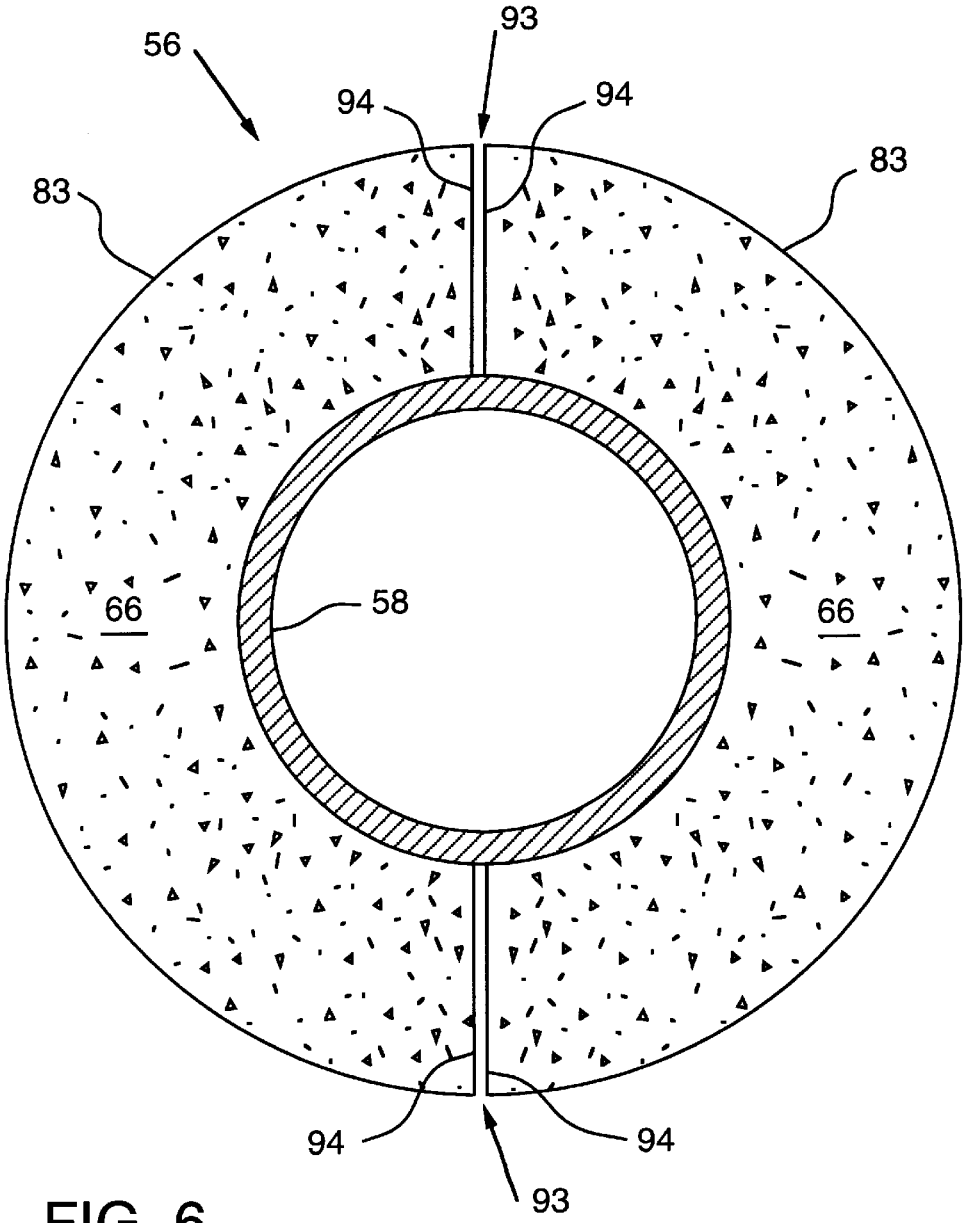
FIG. 6 is a cross sectional view of a pair of the composite refractory insulating tiles of the invention in a plane near one of its longitudinal ends which is indicated at IV—IV of FIG. 2.

FIG. 6 depicts the cross-sectional configuration of each composite tile at portions near each of its longitudinal ends. One of such end positions is indicated on FIG. 2 at plane IV—IV which is perpendicular to longitudinal axis 65 of the tile. Referring to FIG. 6, cast refractory shell 66 extends continuously radially inward from its outer face 83 to pipe 58 and contacts the pipe. Such configured portion extends in the direction of the longitudinal axis a distance of about ¼ to ¾ of an inch inward from end wall 67 as best viewed in FIG. 3 at 91. Such cast refractory configuration is carried out at both longitudinal ends of each tile and assures proper radial alignment of the tiles relative to longitudinal axis 65 of the pipe. Such aligning feature is in addition to that provided near each attachment assembly as described with reference to FIG. 5.

Figure 7:
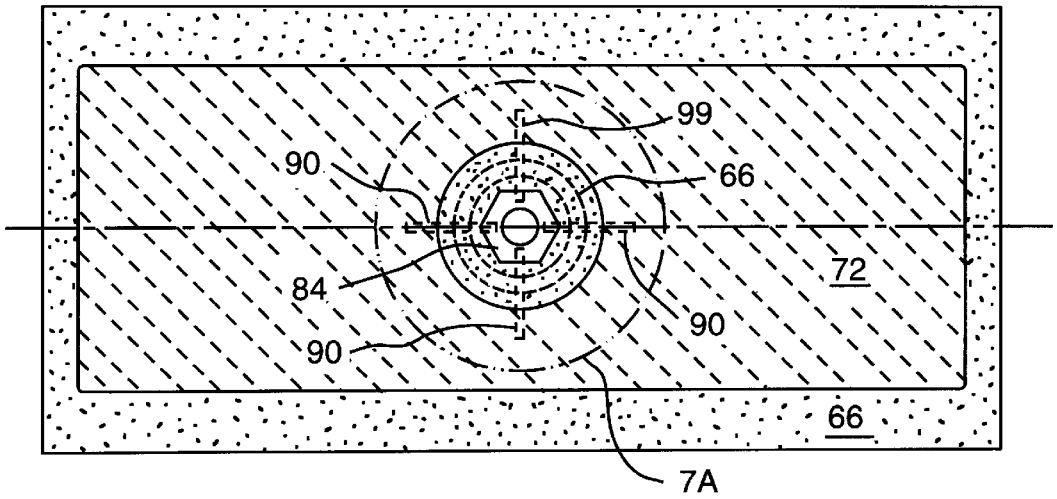
FIG. 7 is a plan view of a composite refractory insulating tile of the invention.
Figure 7A:
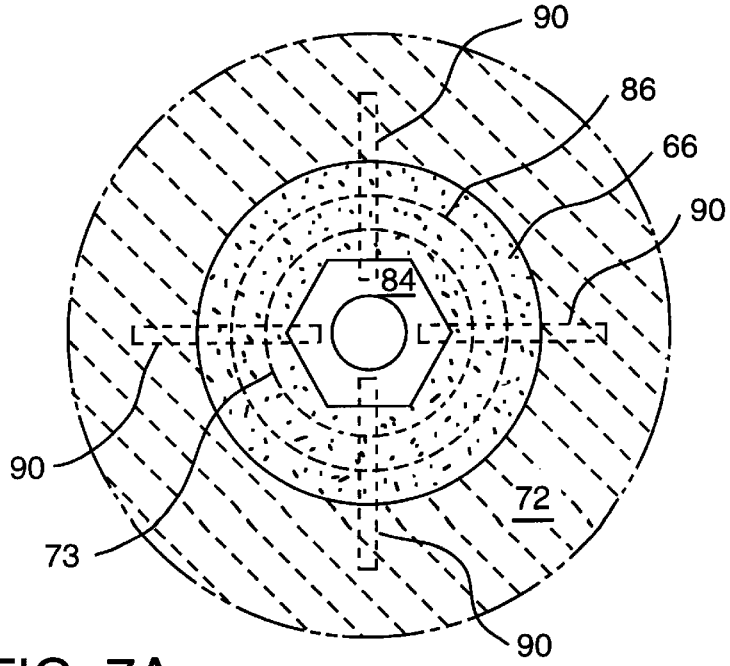
FIG. 7A is an enlarged section of the composite refractory insulating tile of FIG. 7 in the circle indicated at 7A.

The preferred embodiment of the composite tile of the invention is about 12 inches or more in length; however tiles of shorter length are possible. In a 12 inch long tile, for example, a major portion of the tile has ceramic fiber blanket 72 in contact with pipe 58 and only about 10%–20% of the composite tile contacting the pipe is cast refractory shell 66. Such proportions take advantage of the superior insulating properties of ceramic fiber blanket 72 while relying on the rigid properties of cast refractory shell 66 to solidly embed the attachment assemblies and provide solid radial aligning surfaces for contact with pipe 58 when the tiles are disposed about the pipe. Such predominance of ceramic fiber blanket contacting pipe 58 is best viewed in FIGS. 7 and 7A. FIG. 7 is a longitudinal section of a refractory tile depicting cast refractory shell 66 and ceramic fiber blanket 72. Components of the attachment assembly which are embedded in the cast refractory shell are shown in FIG. 7 and in an enlarged view in FIG. 7A. The components include welding base 84, washer 86 and anchoring wires 90. The cast refractory shell encircles only the immediate area of the attachment assembly (at 66) while the ceramic fiber blanket completely encircles the assembly and the cast refractory of such immediate area.

To assure attachment base 84 contacts pipe 58 when the tile is applied a small gap 93, up to about ¼ inch, can be configured between the "C" shaped tiles (FIGS. 2–6). Such gap can be filled with refractory mortar or fiber insulation following installation or a gasket material can be provided during installation. In the embodiment of the invention depicted in FIGS. 2–6 gap 93 is defined by edge walls 94 which extend longitudinally between end walls 67 and 68 (FIG. 2). In the preferred embodiment the edge walls of one tile of the tile pair and in complimentary relationship with the edge walls of the remaining tile of the pair. Preferably the edge wall is planar in shape.

Figure 8:
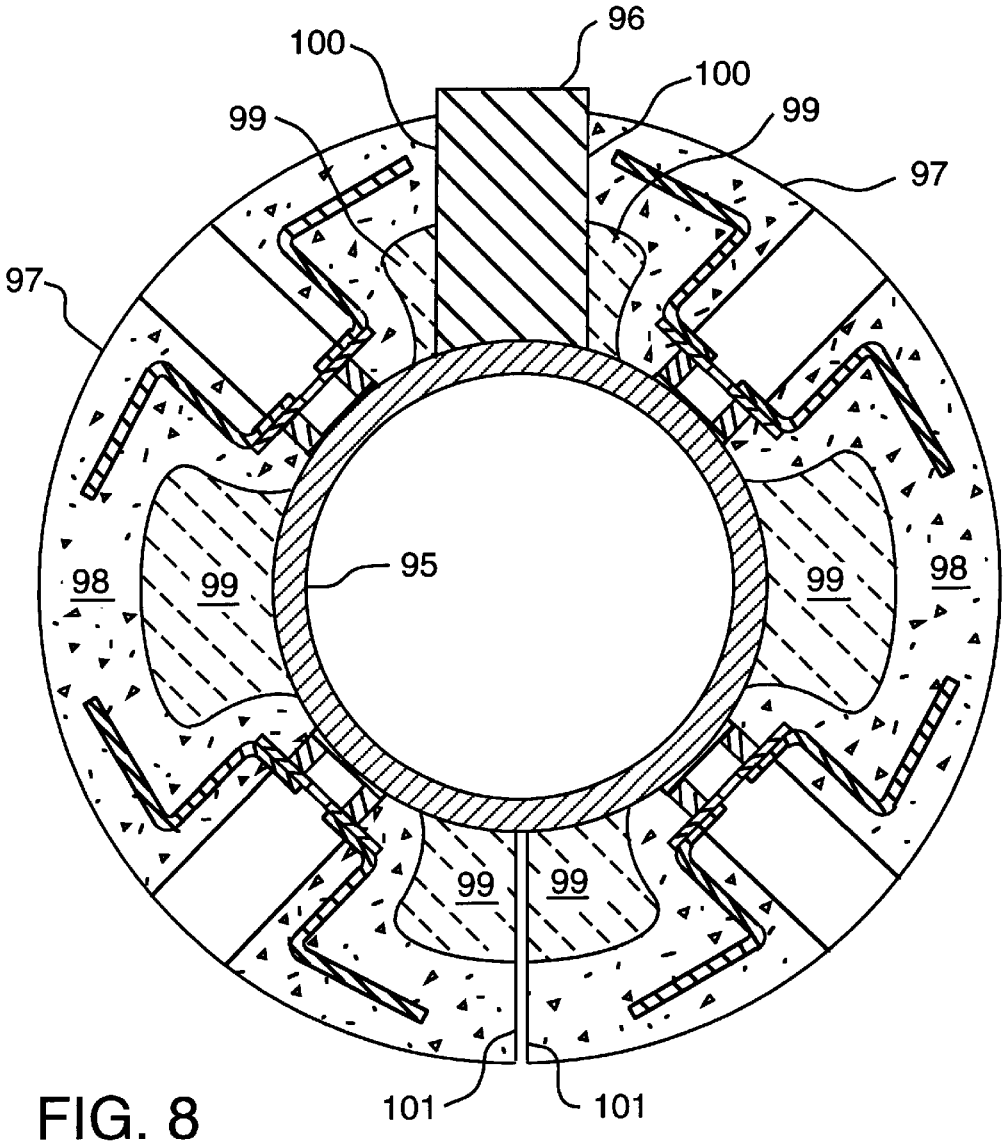
FIG. 8 is a cross sectional view, in a plane through attachment assemblies, of an embodiment of a pair of composite refractory insulating tiles of the invention for use with a water cooled furnace member incorporating a skid rail projecting from its upper surface.

FIG. 8 depicts an embodiment of the pair of composite refractory tiles of the invention for use with a water cooled pipe 95 having a skid-rail wear surface 96 protruding from its upward facing outer surface. Such wear surface 96 extends beyond outer face 97 of the tile in order that the heavy metal sections being heated and slid along rail 96 do not damage the tiles. The embodiment of FIG. 8 is used for an application corresponding to that indicated by pipes 30 and 32 of FIG. 1. The embodiment disclosed in FIGS. 2–6 is used on water cooled pipes such as 40–47 of FIG. 1.

The embodiment of FIG. 8 is shown in cross section only in the immediate area of the attachment assemblies, where cast refractory shell 98, extends radially inward as a protrusion to contact pipe 95. At other portions of each composite tile it is configured similar to that shown in FIGS. 4 and 6; that is the cast refractory contacts pipe 95 at each longitudinal end of each tile and fiber blanket 99 contacts pipe 95 at remaining portions of each tile. In the embodiment of FIG. 8 one of the two edge walls 100 of each tile contacts wear surface 96 while the remaining edge wall 101 is in complimentary relationship with the remaining edge wall of the remaining tile of the pair.

Figure 9:
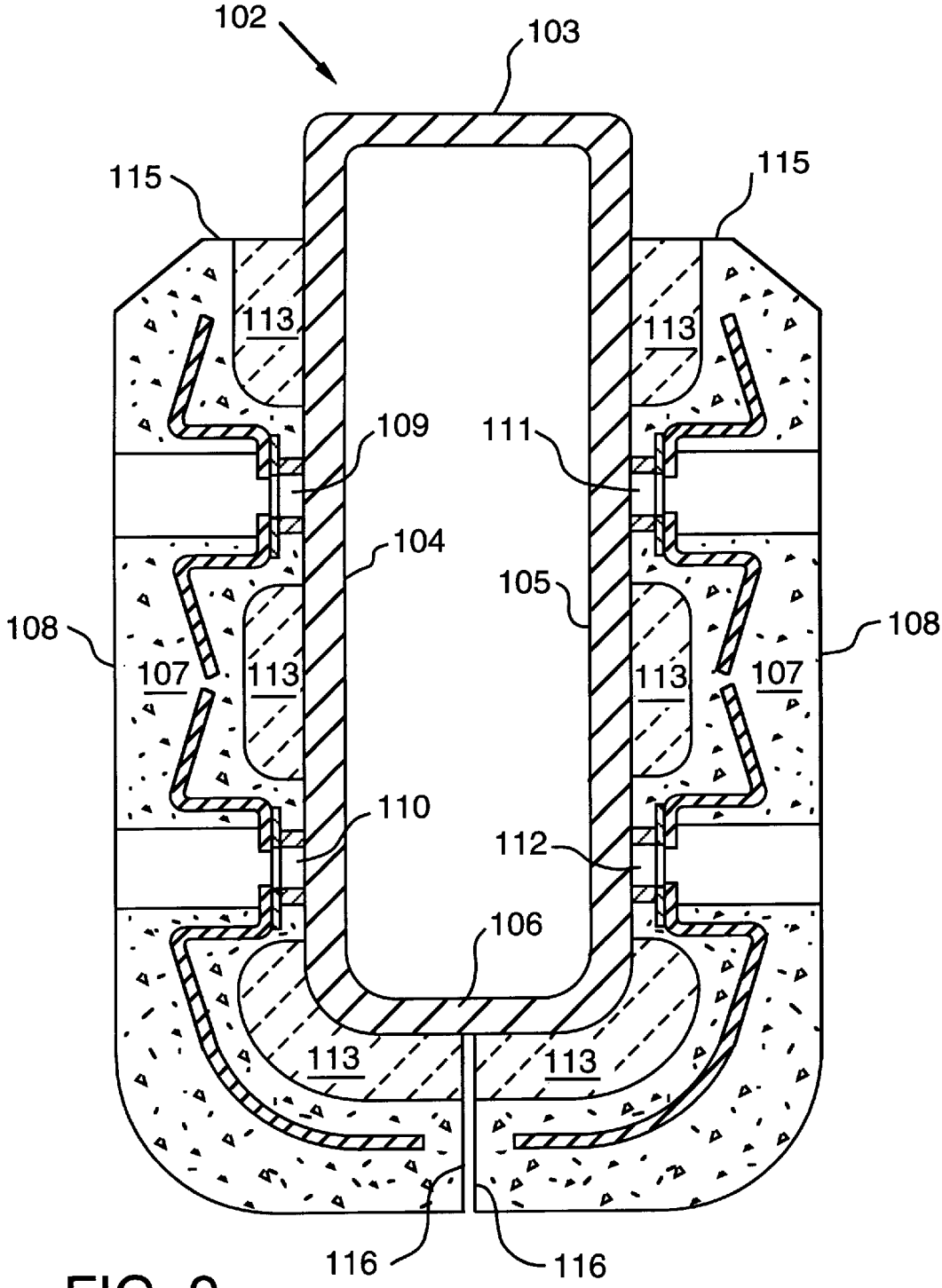
FIG. 9 is a cross sectional view, in a plane through attachment assemblies, of a pair of composite refractory insulating tiles of the invention for use with a water cooled furnace member having a rectangular cross section.

Furnace structural and supporting members other than cylindrically shaped pipes can also be used in metallurgical furnaces, especially for horizontal members supporting heavy steel sections being heated. Water conveying generally rectangularly shaped member 102 is depicted in FIG. 9 having wear surface 103, walls 104 and 105, and bottom 106. The depth of such shape, that is the dimension in a vertical direction of walls 104 and 105, provides more strength, in comparison with that of a pipe, to resist buckling when supporting heavy steel sections being slid and heated. In the embodiment of the pair of composite refractory tiles of the invention depicted in FIG. 9 cast refractory shell 107 of each tile extends from outer face surface 108 radially inward to contact structural member 102 in areas immediately surrounding attachment assemblies 1.09, 110, 111 and 112, and such attachment assemblies are embedded in cast refractory shell 107. In a manner similar to that of the previous two embodiments (FIGS. 3–8), at portions of the composite tile spaced from the attachment assemblies, support member 102 is contacted with insulating fiber blanket 113. Also in a similar manner at longitudinal ends of the composite tile cast refractory shell 107 extends radially inward from outer surface 108 to contact structural member 102. Edge wall 115 of each composite tile ends short of wear surface 103 so as not to be damaged by the heavy metal sections being slid along it and heated in the furnace. Edge wall 116 of each tile is in complimentary relationship with the edge wall of the remaining tile of the pair of tiles.

In all of the embodiments described, the thickness of the insulating fiber blanket is preferably in the range between about ½ and 2 inches; the thickness of the cast refractory shell is preferably in the range between about 1 and 1¾ inch in portions where it does not extend inward to contact the furnace member.

Each composite refractory tile of the pair is preferably produced by first casting the refractory in a mold having a casting cavity comprising a suitable mold outer wall and an opposed mold inner wall conforming to the shape of the furnace member to which it will be applied. Such inner wall incorporates inserts or raised portions, facing the casting cavity, corresponding in shape to the hollow portion of the cast refractory where the fiber blanket will be positioned. The attachment assemblies of each tile are temporarily held in proper position within the mold until solidly embedded in the cast refractory. Following casting and at least partial curing of the refractory the cast refractory shell is removed from the mold and final curing is carried out. In a final step ceramic fiber refractory blanket of a selected thickness is cut to size and fitted into the hollow created during casting by the mold inserts or raised portions incorporated in the inner wall of the mold.

A second method of producing the composite refractory tile comprises cutting pieces of fiber blanket to the proper shape and placing them against a mold inner wall which conforms to the shape of the furnace member to which it will be applied; placing a mold outer wall in proper position to form a casting cavity; and casting the refractory.

While specific materials, dimensional data, and fabricating steps have been set forth for purposes of describing embodiments of the invention, various modifications can be resorted to, in light of the above teachings, without departing from applicant's novel contributions; therefore in determining the scope of the present invention, reference shall be made to the appended claims.

What is claimed is:

1. A pair of insulating composite refractory tiles for placement together about a fluid-cooled member of a metallurgical furnace, each tile comprising:

a cast refractory shell adapted to be disposed about an exterior surface of the fluid-cooled member, said shell having an inner face and an opposed outer face, opposed end walls, and edge walls extending between said end walls;

attaching means embedded within said cast refractory shell and extending for contacting the exterior surface of the fluid-cooled member;

said inner face of the shell having portions immediately surrounding the attaching means and adjacent each end wall of the tile for contacting the exterior surface of the fluid-cooled member, and a major remaining portion of the inner face configured to be spaced from the exterior surface of the fluid-cooled member and defining a hollow, at least one of said edge walls configured to be complimentary to at least one of the edge walls of the other of said pair of tiles; and a ceramic fiber blanket filling said hollow for contacting the exterior surface of the fluid cooled member.

2. A pair of insulating composite refractory tiles according to claim 1 wherein said ceramic fiber blanket has a thickness in the range of about ½ to 2 inches.

3. A pair of insulating composite refractory tiles according to claim 1, wherein said cast refractory shell has a thickness in the range of about ½ to 1¾ inches in portions for the inner face to be spaced from the exterior surface of the fluid-cooled member.

4. A pair of insulating composite refractory tiles according to claim 1, wherein each attaching means comprises a base for welding to the exterior surface of the fluid-cooled member, and anchoring wires embedded in the cast refractory shell.

5. A pair of insulating composite refractory tiles according to claim 1, for placement together about a furnace member to be insulated having a cylindrically shaped exterior surface, wherein the pair of tiles are configured to extend 360° around the pipe and each tile has two edge walls for complimenting the two edge walls of the other tile.

6. A pair of insulating composite refractory tiles according to claim 1, for placement together about a furnace member to be insulated having a cylindrically shaped exterior surface incorporating a skid rail wear surface, wherein the tiles are configured to extend around the pipe less than 360° so as to expose the skid rail wear surface and each tile has one edge wall configured to be complimentary to one edge wall of the other tile.

7. A pair of insulating composite refractory tiles according to claim 1 for placement together about a fluid-cooled member to be insulated having a rectangular cross section incorporating a top wear surface, two sides and a bottom, wherein the pair of tiles are configured to engage a major portion of the sides and the bottom of the fluid-cooled member.

8. A pair of insulating composite refractory tiles according to claim 1, further comprising a welding access cavity, associated with each attaching means, extending through the cast refractory shell from the attaching means to the outer face of the tile.

9. A pair of insulating composite refractory tiles according to claim 8, wherein dimensions of each said welding access cavity enable use of a mig-welder to weld the attachment means to the fluid-cooled member.

10. A pair of insulating composite refractory tiles according to claim 1, wherein each pair of complimentary edge walls is disposed to form a gap of about ⅛ to ⅜ of an inch between them.

11. A pair of insulating composite refractory tiles for placement together in a metallurgical furnace about a fluid-cooled cylindrically shaped furnace member incorporating an upward projecting skid rail, each tile comprising:

a cast refractory shell adapted to be disposed about a portion of the fluid-cooled furnace member, said shell having an inner face and an opposed outer face, opposed end walls, and two edge walls extending between said end walls, means embedded within the refractory shell for attaching said tile to the furnace member, said inner face, configured for contacting the furnace member at portions immediately surrounding the attaching means and at portions adjacent each end wall, and configured to be spaced from the furnace member at remaining portions and defining a hollow, and a ceramic fiber blanket filling said hollow for contacting the furnace member;

one of said two edge walls configured to compliment one of the edge walls of the other tile and the remaining edge wall configured to contact the projecting skid rail of the furnace member.

12. A pair of insulating composite refractory tiles for placement together in a metallurgical furnace about a fluid-cooled elongated furnace member having a generally rectangular shaped cross-section perpendicular to its longitudinal axis, having an upward facing wear surface, an opposed bottom and two opposed sides, each tile comprising:

a cast refractory shell adapted to be disposed about a portion of the fluid-cooled furnace member, said shell having an inner face and an opposed outer face, opposed end walls, and two edge walls extending between said end walls, means embedded within the refractory shell for attaching the tile to a side of the furnace member, said inner face, configured for contacting the furnace member at portions immediately surrounding the attaching means and at portions adjacent each end wall, and configured to be spaced from the furnace member at remaining portions and defining a hollow, a ceramic fiber blanket filling said hollow for contacting the furnace member, and one of said two edge wails configured for complimenting one of said edge walls of the other tile and the remaining edge wall configured to have an upward facing orientation and disposed vertically below the upward facing wear surface of t he furnace member.

13. An insulating system for a metallurgical furnace having fluid-cooled furnace members, comprising a plurality of pairs of composite refractory tiles according to claim 1 arranged end-to-end, and gaskets located between end walls of adjacent tile pairs.

* * * * *